US006551456B2

(12) United States Patent
Wang et al.

(10) Patent No.: US 6,551,456 B2
(45) Date of Patent: Apr. 22, 2003

(54) PROCESS TO PREPARE SYNTHETIC FIBER PAPER

(75) Inventors: Xingli Wang, Chengdu (CN); Shiyi Tao, Chengdu (CN)

(73) Assignee: Sichuan Foreign Economic Relations & Trade Corporation, Chengdu Sichuan (CN)

( * ) Notice: Subject to any disclaimer, the term of this patent is extended or adjusted under 35 U.S.C. 154(b) by 0 days.

(21) Appl. No.: 10/183,101

(22) Filed: Sep. 3, 2002

(65) Prior Publication Data

US 2003/0051838 A1 Mar. 20, 2003

Related U.S. Application Data

(62) Division of application No. 09/488,333, filed on Jan. 20, 2000, now Pat. No. 6,458,244.

(30) Foreign Application Priority Data

Jan. 22, 1999 (CN) ..... 99114635

(51) Int. Cl.[7] ..... D21H 13/24; D21H 13/26; D21H 17/68; D21H 27/12

(52) U.S. Cl. ..... 162/146; 162/138; 162/149; 162/157.3; 162/181.6

(58) Field of Search ..... 162/158, 141, 162/146, 145, 149, 138, 157.3, 168.1, 181.1, 181.6, 181.7; 428/326, 323, 338, 324, 327; 442/415, 93, 169, 117, 147, 168

(56) References Cited

U.S. PATENT DOCUMENTS 3,168,434 A * 2/1965 Heyman ..... 162/146
3,622,445 A * 11/1971 Heidweiller ..... 162/145
3,756,909 A * 9/1973 Gross ..... 162/146
4,320,081 A * 3/1982 Lammers ..... 264/184
4,541,894 A * 9/1985 Cassat ..... 162/138
4,698,267 A * 10/1987 Tokarsky ..... 428/474.4
4,714,650 A * 12/1987 Obayashi et al. ..... 442/93
4,729,921 A * 3/1988 Tokarsky ..... 428/326
5,336,556 A * 8/1994 Yoshida et al. ..... 442/414
5,403,444 A * 4/1995 Goettmann et al. ..... 162/146
5,415,738 A * 5/1995 Mehta et al. ..... 162/146
5,783,039 A * 7/1998 Murayama ..... 162/146
6,171,443 B1 * 1/2001 Goettmann et al. ..... 162/135

FOREIGN PATENT DOCUMENTS

EP 0 289 860 A1 * 11/1988
EP 0 344 318 A1 * 12/1989
EP 0 681 620 B1 * 11/1995
EP 0 854 213 A1 * 7/1998

* cited by examiner

*Primary Examiner*—Jose A. Fortuna
(74) *Attorney, Agent, or Firm*—Cohen, Pontani, Lieberman & Pavane

(57) ABSTRACT

The present invention provides a synthetic fiber paper, the synthetic fiber paper comprises poly (phenylene terephthal amide) fiber, polyethylene glycol terephthalate fiber and powdered mica. The synthetic fiber paper has high-temperature resistance, high strength, low-deformability, resistivity against fire, burning resistance, resistance to chemical corrosion and excellent property of electric insulation, it can be widely applied in the field of mechano-electronics product, aviation, aerospace, military project for national defence, high-tech areas for civil use, high-voltage equipment, high-temperature circumstance as insulting material, it often can be used in composite materials with special use as structural material. The present invention also provides a process for preparing this synthetic fiber paper.

11 Claims, 1 Drawing Sheet

PROCESS TO PREPARE SYNTHETIC FIBER PAPER

CROSS-REFERENCE TO RELATED APPLICATION(S)

This application is a Divisional of U.S. patent application Ser. No. 09/488,333, filed Jan. 20, 2000 now U.S. Pat. No. 6,458,244.

BACKGROUND OF THE INVENTION

1. Field of the Invention

This invention relates to a synthetic fiber paper, particularly to a fiber paper made of aromatic polyamide synthetic fiber as main raw material; this invention also relates to a process for preparing the synthetic fiber paper.

2. Description of the Related Art

The synthetic fiber paper of aromatic polyamide is a paper-like material made of synthetic fiber of aromatic polyamide as raw material through a special papermaking technology. Owing to high-temperature resistance, high strength, low-deformability, resistivity against fire, burning resistance, resistance to chemical corrosion and excellent property of insulation, it has been widely used in some high-tech areas such as mechano-electronics product, aviation, aerospace etc. At present, the fiber paper of aromatic polyamide sold on the market, trade name being called as "Nomex Brand paper, uses the fiber of poly (m-phenylene metaphthal amide). However, there is no any satisfied process for preparing the said synthetic fiber paper has been disclosed vet.

SUMMARY OF THE INVENTION

In view of the shortage of the prior art, the object of the present invention is to provide a synthetic fiber paper made of poly (p-phenylene terephthal amide) as raw material. This fiber paper has high-temperature resistance, high strength, low-deformability, resistivity against fire, burning resistance, resistance to chemical corrosion and excellent property of insulation.

The another object of the present invention is to provide a process for preparing a synthetic fiber paper made of poly (p-phenylene terephthal amide) fiber as raw material.

The present invention provides a synthetic fiber paper comprises (parts by weight):

| | |
|---|---|
| Poly (p-phenylene terephthal amide) fiber | 50–80 |
| Polyethylene glycol terephthalate fiber | 20–50 |
| Powdered mica | 0–50 |

Preferably, the above-mentioned synthetic fiber paper comprises (parts by weight):

| | |
|---|---|
| Poly (p-phenylene terephthal amide) fiber | 70–80 |
| Polyethylene glycol terephthalate fiber | 20–30 |

The no-stuffing synthetic fiber paper can be produced in proportion as aforesaid content.

More preferably, the above-mentioned synthetic fiber paper comprises (parts by weight):

| | |
|---|---|
| Poly (p-phenylene terephthal amide) fiber | 60–70 |
| Polyethylene glycol terephthalate fiber | 30–40 |
| Powdered mica | 0–10 |

The low stuffing synthetic fiber paper can be produced in proportion as aforesaid content. Powdered mica with 5–20 $\mu$m is preferably used in present invention.

More preferably, the above-mentioned synthetic fiber paper comprises (parts by weight):

| | |
|---|---|
| Poly (p-phenylene terephthal amide) fiber | 50–60 |
| Polyethylene glycol terephthalate fiber | 40–50 |
| Powdered mica | 10–15 |

The high stuffing synthetic fiber paper can be produced in proportion as aforesaid content.

The said poly (p-phenylenc terephthal amide) fiber is 1.5–2.0 d in size, 4–6 m/m in length. The polyethylene glycol terephthalate fiber is 1.5–2.0 d in size and 4–6 m/m in length.

The process for preparing the synthetic fiber paper comprising the following steps of compounding and pulping, papermaking shaping, dehydrating, drying preheating, prepressing. high-pressure hot-rolling, trimming, wherein the untreated poly (p-phenylene terephthal amide) fiber and the polyethylene glycol terephthalate fiber are in proportion loosened and dissociated before the step of compounding and pulping, then mixing with the treated poly (p-phenylene terephthal amide) fiber to compound and pulp.

The proportion between the said untreated poly (p-phenylene terephthal amide) fiber and the treated poly (p-phenylene terephthal amide) fiber is preferably 1:1–0.2 by weight, more preferably is 1:0.34 by weight.

In the said process, before compounding and pulping, the powdered mica should be also mixed with the processing additives to be a homogeneous material.

The said processing additives are an inorganic gel and/or polyethylene glycol oxide.

In the process of present invention, the preheating temperature is 240–250° C., the prepressing pressure is 1–2 Mpa, the temperature of high-pressure hot rolling is 255–265° C. and the linear pressure is 500–3000 N/cm

DETAILED DESCRIPTION OF THE PRESENTLY PREFERRED EMBODIMENTS

Figure 1:
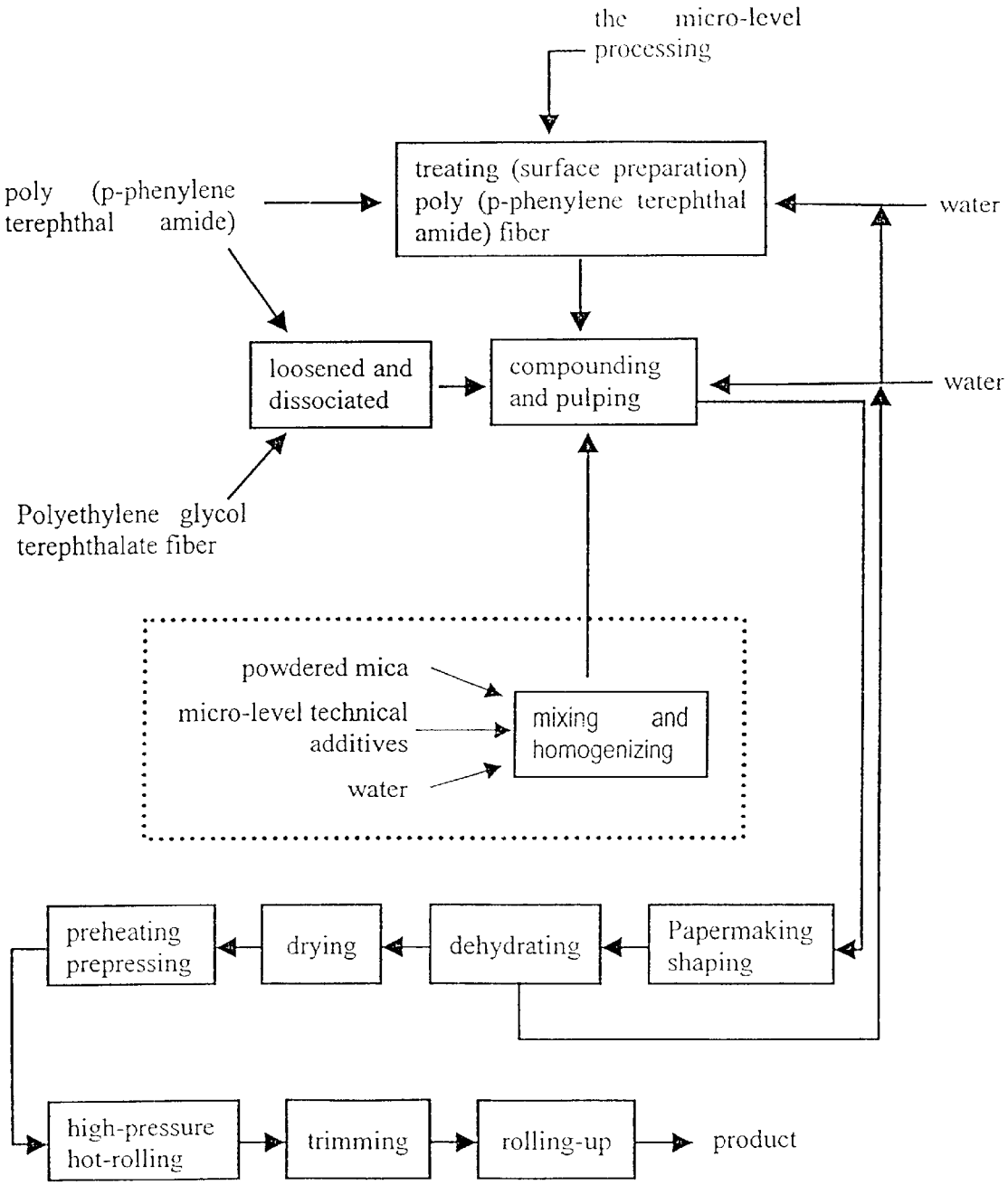
FIG. 1 is a flow diagram process for preparation of the present invention.

The poly (p-phenylene terephthal amide) fiber (Aromatic polyamide fiber 1414) is a structure fiber with general formula as follow:

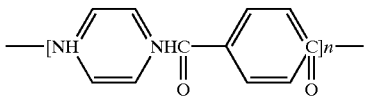

It can be produced by a process comprising following steps: terephthalyl chloride and p-phenylene diamine as raw material, are polycondensed in NMP—$Cacl_2$ as solvent under low-temperature to poly (p-phenylene terephthal amide) resin, then undergoing liquid crystal spinning, being cut to length as required, or is precipitated directly to short fiber. The fiber has outstanding high strength (the highest tensile strength 200 CN/betx, shearing 0.29, elongation at rupture 3%), high modulus of elasticity (up to 67 $KN/mm^2$), high hot resistance (decomposition point 500° C.), resistivity against fire, burning resistance, resistance to chemical corrosion and excellent property of insulation, therefore the synthetic fiber paper made of poly (p-phenylene terephthal amide) as a main component of structural fiber also has the above-mentioned outstanding excellent properties.

Because of insufficient binding force of the synthetic fibers, the synthetic fibers can not be papermaking shaping as a plant fiber does. Binding of the synthetic fibers depends mainly on adhesion of melted fiber. However the poly (p-phenylene terephthal amide) fiber doesn't have a distinct melting point, therefore during papermaking shaping some fiber having lower melting point present as crosslinking fiber has to be added. When the paper blank of synthetic fiber is rolled at nearly melting point of the crosslinking fiber, the soft and melted crosslinking fiber binds the unmelted poly (p-phenylene terephthal amide) fiber to form net-like material, so as to be finalized. In this invention the polyethylene glycol terephthalate fiber (polyester fiber) is used as the crosslinking fiber. Its structural formula:

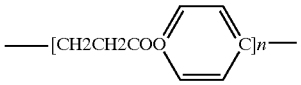

The softening point of the fiber is 238–240° C., melting point is 255–260° C. The fiber has higher softening temperature than using temperature of the synthetic fiber paper 220° C., and higher strength, excellent electric insulation. That the polyethylene glycol terephthalate fiber is added properly as a crosslinking fiber doesn't drop the physical mechanical index and electric insulation of the synthetic fiber paper too much. While stuffing is used, the amount of the crosslinking fiber used in the present invention preferably increases to 40~50 parts by weight, most preferably increases to 30 parts by weight.

When the synthetic fiber paper is used in place where there are high-voltage and frequent or uninterrupted corona discharge being used, it is necessary to add and mix the powdered mica while papermaking, the ability for products resisting to corona discharge is strengthened by stuffing of powdered mica. The proportion of stuffing level depends on its uses, varying from 0 to 50 parts by weight. While the stuffing level reaches 50 parts by weight (high stuffing), the product also has the properties of mica besides the properties of original high strength and high-temperature resistance etc.

In the process for preparing the synthetic fiber paper of the present invention, in order to increase dispersion of fiber in water, while mixing and pulping, a micro-level of high viscosity material should be added to gets the pulp slurry to have some viscosity, increases the movement resistance of fiber in the pulp, delays the twining and flocculating of fiber, so as to improve dispersing and suspending of the fiber in pulp. finally achieves the aim of increasing homogeneity of the synthetic fiber paper.

The micro-level of residual viscosity increaser in the paper blank for papermaking shaping makes the fiber some adhesion, so that it makes the paper blank retain initial strength before finalizing, and will not get rupture in the process of transporting pulling apart from a foundation fabric. The process of papermaking can run smoothly.

The viscosity increaser used in this invention can be selected from a group consisting of inorganic gel SM and polyethylene glycol Oxide PG. They can be either used separately, or as combination. The amount of it is about 0.3–0.8%. It can be able to be adjusted, depending on the viscosity of viscosity increaser, the type, gauge of paper and the type of papermaking machine. In general, the use level for thick paper is adequately more than for thin. The use level for stuffing paper is more than for no-stuffing.

In order to improve the homogeneity of paper blank for papermaking, it is very necessary for the poly (p-phenylene terephthal amide) fiber to have surface-preparation. This surface-preparation changes the properties of fiber surface, enhances an affinity of fiber to water, so that the dispersing and suspending fiber in water persists for a longer time. There are many process for treating poly (p-phenylene terephthal amide) fiber. Here is a mechanical process or a mechanico-chemical combined process is used. It means that the poly (p-phenylene terephthal amide) fiber is beaten by a beater, then it will be shorn and torn to reduce the length of fiber and to make its surface roughness. While beating, the micro-level of processing additives also can be added, after that it will be mixed and beaten, it is what is called the mechanico-chemical combined process. In practical production, it is also possible to apply poly (p-phenylene terephthal amide) fibers in two different lengths combined (especially suitable for super short fiber which is directly produced by precipitating process). Same effect result can be achieved.

Because the synthetic fiber paper should have both a better tensile strength, elongation rate, density, and a higher tearing strength, initial tear, at the same time, it also should have the property of the best homogeneity in the process of papermaking, in order to resolve the contradiction between demanding fiber length of the tearing strength and of tensile strength, in present invention, a certain amount of untreated poly (p-phenylene terephthal amide) (long fiber) as skeleton of paper blank compounded in part of treated poly (p-phenylene terephthal amide) fiber(short fiber) is compounded in part and stuffed in the skeleton of the poly (p-phenylene terephthal amide) fiber to be untreated, the interweaving of long fiber with short fiber trends further towards homogeneity, thereby enhances the papermaking homogeneity of the paper blank and the interweaving density of fibers.

TABLE 1

The effects on physical, mechanical properties of paper blank by compounding proportion of two types of poly (p-phenylene terephthal amide) fibers

| | Untreated fibers | | | |
|---|---|---|---|---|
| Treated fibers | Density of paper blank $g/cm^3$ | Tearing strength index $CN \cdot m^2/g$ | Initial tear index $N \cdot m^2/g$ | Tensile strength index $N \cdot m/g$ |
| 1:1 | 0.19 | 2.48 | 0.44 | 27.7 |
| 1:0.34 | 0.20 | 3.75 | 0.61 | 20.7 |
| 1:0.2 | 0.21 | 5.21 | 0.73 | 9.24 |

In order to prevent the crosslinking fiber from being over melted and the technical properties of synthetic fiber paper being affected. The temperature of preheating and hot-rolling should be controlled precisely at a point of temperature selected, the error in temperature is ±1° C.

Because the heat conductivity coefficient of paper blank is lower, its heat conduction is slow, the thicker the synthetic fiber paper is, the longer the preheating time will be.

The synthetic fiber paper of the present invention is a kind of new synthetic material with high performance. It is a paper-like material made of the synthetic fiber of aromatic polyamide as main component and produced by special papermaking technology. It has high-temperature resistance (suitable used to be at −190–310° C., and can be used for long time below 220° C.), high strength, low-deformability, resistivity against fire, burning resistance, resistivity to chemical corrosion and excellent property of electric insulation. The low-density, middle-density, high-density paper of synthetic fiber can be produced by the means of changing the character of fiber, the ratio of two fibers, hot-rolling pressure as required according to the different use.

The type of no-stuffing, low-stuffing and high-stuffing products can be produced by means of changing the proportion of stuff to be added. The products also can be made to have different thickness gauge (0.05–10 mm) (if more than 1.0 mm, be called as fiber paperboard) and different width gauge. The present invention can provide a series of products with different type and different gauge to meet the needs in different technical areas. The synthetic fiber paper in the present invention can be widely applied in the field of mechano-electronics, aviation, aerospace, military project for national defense, high-tech areas for civil use, high-voltage equipment, high-temperature circumstance as insulating material, besides, it often can be used in composite material with special use as structural material.

EXAMPLES

Example 1

According to following proportion, the synthetic fiber paper of example 1 was produced by a process of the present invention.

| | |
|---|---|
| Poly (p-phenylene terephthal amide) fiber | 70 kg |
| Polyethylene glycol terephthalate fiber | 30 kg |

The above-mentioned poly (p-phenylene terephthal amide) filer comprises 52kg of untreated poly (p-phenylene terephthal amide) fiber having 1.5d in size and 6m/in in length and 18kg of the treated poly (p-phenylene terephthal amide) fiber. The polyethylene glycol terephthalate fiber is 1.5d in size and 6m/m in length.

The above-mentioned process of the present invention comprises:

Referring to FIG. 1, the untreated poly (p-phenylene terephthal amide) fiber were subjected to be loosened and dissociated, then was compounded with the treated poly (p-phenylene terephthal amide) fiber to make pulp, through the steps of papermaking shaping, dehydrating, drying, preheating and prepressing at 245° C. and under 2Mpa, hot-rolling under 600N/cm of linear pressure and at 260° C., so as to make a no-stuffing synthetic fiber paper with low density of 0.3—0.5 g/cm$^2$ then trimming, rolling-up, to obtain the product. The wastewater from dehydrating can be recycled after it was treated as required.

Example 2

According to the process indicated as example 1, except that the hot-rolling pressure during the stage of high pressure hot-rolling was 1200 N/cm. Finally a no-stuffing middle-density synthetic fiber paper having density of 0.5—0.99g/m$^3$ was obtained.

Example 3

The same ratio of two synthetic fiber papers and process as described for example 1 were used except that the linear pressure at high-pressure hot-rolling is 3000N/cm. Finally no- stuffing high-density synthetic fiber paper having density of 0.91—1.2g/cm$^3$ was obtained.

Example 4

According to following proportion, the synthetic fiber paper of example 4 was produced by a process substantially same as the process described in example 1:

| | |
|---|---|
| Poly (p-phenylene terephthal amide) fiber | 65 kg |
| Polyethylene glycol terephthalate fiber | 30 kg |
| Powdered mica (5–10 μm in graininess) | 1 kg |

The above-mentioned poly (p-phenylene terephthal amide) fiber comprises 45kg of untreated poly (p-phenylene terephthal amide) fiber with 1.5d in size and 6m/m in length and 20kg of treated poly (p-phenylene terephthal amide) fiber. The polyethylene glycol terephthalate fiber with 1.5d in size and 4mm in length is adopted.

The process of example 4 is substantially same as the process described in example 1, except that before compounding and pulping, powdered mica, water and micro-level of processing additives - - - polyethylene glycol oxide have to be mixed and homogenized, then they are added to the above-mentioned composition consisting of poly (p-phenyleue terephthal amide) fiber and polyethylene glycol terephthalate liber to be made compound and pulp; preheating temperature is 250° C., prepressing pressure is 1.5Mpa; the temperature at the high- pressure hot-rolling is 265° C., the linear pressure is 1500N/cm.

Example 5

According to following proportion, compound and manufacturc the synthetic fiber paper in example 5 was produced

| | |
|---|---|
| Poly (p-phenylene terephthal amide) fiber | 50 kg |
| Polyethylene glycol terephthalate fiber | 50 kg |
| Powdered mica (5–10 μm in graininess) | 50 kg |

The above-mentioned poly (p-phenylene terephthal amide) fiber comprises 40)kg of untreated poly (p-phenylene terephthal amide) fiber having 1.5d in size and 6m/m in length and 10kg of treated poly (p-phenylene terephthal amide) fiber. The polyethylene glycol terephthalate fiber adopted is 2.0d in size and 6m/m in length.

The process used in example 5 is same as the process described in example 4.

Example 6

According to the following proportion, compound and manufacture the synthetic fiber paper of example 6 was produced:

| | |
|---|---|
| Poly (p-phenylene terephthal amide) fiber | 60 kg |
| Polyethylene glycol terephthalate fiber | 40 kg |
| Powdered mica (10–5 μm in graininess) | 10 kg |

The above-mentioned poly (p-phenylenc tcrephthal amido) fiber comprises 45kg of the untreated poly (p-phenylene terephthal amide) fiber having 2d in size and 6m/m in length and 15kg of the treated poly (p-phenylene terephthal amide) fiber. The polyethylene glycol terephthalate fiber used is 2d in size and 6m/m in length.

The process of example 6 is substantially same as the process described in example 4, except that the high-pressure hot-rolling was carried out at 265° C. and 2000N/cm of the linear pressure.

Example 7

According to following proportion, compound and manufacture the synthetic fiber paper of example 7 was produced:

| | |
|---|---|
| Poly (p-phenylene terephthal amide) fiber | 60 kg |
| Polyethylene glycol terephthalate fiber | 40 kg |
| Powdered mica (10–20 μm in graininess) | 10 kg |

The above-mentioned poly (p-phenylene terephthal amide) fiber comprises 40kg of the untreated poly (p-phenylene terephthal amide) fiber having 1.5d in size and 6m/m in length and 20kg or the treated poly (p-phenylene terephthal amide) fiber. The polyethylene glycol terephthalate fiber adopted is 1.5d in size and 4m/m in length.

The production process of example 7 is substantially same as the process described in example 6.

Example 8

According to following proportion, compound and manufacture the synthetic fiber paper of example 8 was produced:

| | |
|---|---|
| Poly (p-phenylene terephthal amide) fiber | 50 kg |
| Polyethylene glycol terephthalate fiber | 50 kg |
| Powdered mica (10–20 μm in graininess) | 50 kg |

The above-mentioned poly (p-phenylene terephthal amide) fiber comprises 30kg of the untreated poly (p-phenylene terephthal amide) fiber having 1.5d in size and 6m/m in length and 20kg of the treated poly (p-phenylene terephthal amide) fiber. The polyethylene glycol terephthalatc fiber used was 1.5d in size and 5m/m in length.

The production of example 8 is substantially same as the process described in example 6.

Example 9

According to following proportion, compound and manufacture the synthctic fiber paper of the example 9 was produced

| | |
|---|---|
| Poly (p-phenylene terephthal amide) fiber | 50 kg |
| Polyethylene glycol terephthalate fiber | 50 kg |

The above-mentioned poly (p-phenylene terephthal amide) fiber was 5d in size and 6m/m in length. The polyethylene glycol terephthalate fiber was 1.5d in size and 4m/m in length. The process is substantially sane as the process described in example 3, except that the beating process was carried out prior to compounding.

Although particular embodiments of the present invention have been described in the foregoing description, it will be understood by those skilled in the art that the invention is capable of numerous modifications, substitutions and rearrangements without departing from the spirit or essential attributes of the invention. Reference should be made specification, as indicating the scope of the invention.

We claim:

1. A process of preparing a synthetic fiber paper having 50–80 parts, by weight, of poly(p-phenylene terephthal amide) fibers, 20–50 parts, by weight, of polyethylene glycol terephthalate fibers, and 0–50 parts, by weight, of powdered mica, comprising the following steps:

treating the surface of a portion of said poly(p-phenylene terephthal amide) fibers to produce treated poly (p-phenylene terephthal amide) fibers;

loosening and dissociating remaining of said poly (p-phenylene terephthal amide) fiber and said polyethylene glycol terephthalate fibers to produce loosened and dissociated fibers;

compounding and pulping said treated poly (p-phenylene terephthal amide) fiber and said loosened and dissociated fibers to produce a pulp; and processing said pulp to produce said synthetic fiber paper wherein said polyethylene glycol terephthalate fibers have a melting point of about 255–260° C.

2. The process according to claim 1, wherein said poly (p-phenylene terephthal amide) fiber and said treated ploy (p-phenylene terephthal amide) are compounded and pulped in a proportion of 1:0.2–1.

3. The process according to claim 2, wherein the proportion of said poly (p-phenylene terephthal amide) fiber to said treated ploy (p-phenylene terephthal amide) is 1:0.34.

4. The process according to claim 1, further comprising the step of mixing said powdered mica with processing additives to form a homogenous mixtures before said compounding and pulping.

5. The process according to claim 4, wherein said processing additives are inorganic gel and/or polyethylene glycol oxide.

6. The process according to claim 1, wherein said processing step comprises papermaking shaping, dehydrating, drying, preheating, prepressing, high-pressure hot-rolling and trimming.

7. The process according to claim 6, wherein said preheating temperature is 240–250° C.; said prepressing pressure is 1–2 Mpa; said high pressure hot-rolling temperature is 255–265° C.; and said high pressure hot-rolling linear pressure is 500–3000 N/cm.

8. The process according to claim 1, wherein said synthetic fiber paper comprises 70–80 parts, by weight, of poly (p-phenylene terephthal amide) fibers and 20–30 parts, by weight, of polyethylene glycol terephthalate fibers.

9. The process according to claim 1, wherein said synthetic fiber paper comprises 60–70 parts, by weight, of poly(p-phenylene terephthal amide) fibers, 30–40 parts, by weight, of polyethylene glycol terephthalate fibers and 0–10 parts, by weight, of powdered mica.

10. The process according to claim 1, wherein said synthetic fiber paper comprises 50–60 parts, by weight, of poly(p-phenylene terephthal amide) fibers, 40–50 parts, by weight, of polyethylene glycol terephthalate fibers and 10–50 parts, by weight, of powdered mica.

11. The process according to claim 1, wherein said poly (p-phenylene terephthal amide) fibers are 1.5–2.0 d in size and 4–6 m/m in length, and said polyethylene glycol terephthalate fibers are 1.5–2.0 d in size and 4–6 m/m in length.

* * * * *